US005984306A

United States Patent [19]

Cotter et al.

[11] Patent Number: 5,984,306

[45] Date of Patent: Nov. 16, 1999

[54] GAME WITH TIME-ESTIMATING ELEMENT

[76] Inventors: John Christopher Cotter, 4407 Bouvet Ct., Austin, Tex. 78727; Alden J. Balmer, 1809 Laurel Path, Round Rock, Tex. 78664

[21] Appl. No.: 09/059,628

[22] Filed: Apr. 13, 1998

[51] Int. Cl.[6] ..... A63F 3/00

[52] U.S. Cl. ..... 273/243; 273/445

[58] Field of Search ..... 273/243, 249, 273/445, 255

[56] References Cited

U.S. PATENT DOCUMENTS 4,817,959 4/1989 Tinsley ..... 273/249

5,360,216 11/1994 Counterman ..... 273/243

5,609,339 3/1997 Mahoney ..... 273/255

*Primary Examiner*—Benjamin H. Layno

*Attorney, Agent, or Firm*—Joseph N. Breaux

[57] ABSTRACT

A game with a time-estimating element wherein the time-estimating element is accomplished by starting and stopping a stopwatch. The game includes a game board having token spaces laid out thereon and wherein each player can elect to travel in any direction between adjacent token spaces during his/her given turn. The game includes a number of time-estimating challenges. The game can be won by outlasting the other players, i.e. having time remaining on his/her time-keeping timeline, or by being the first to collect a preset number of time-saver cards.

7 Claims, 4 Drawing Sheets

GAME WITH TIME-ESTIMATING ELEMENT

TECHNICAL FIELD

The present invention relates to games and more particularly to a board game that includes a number of time-estimating challenges that include attempting to achieve a target time on a stopwatch.

BACKGROUND ART

Board games are a popular pastime for many individuals. As such, it would be a benefit to have a board game. Because many individuals can enjoy playing board games that include elements of luck and skill, it would be a benefit to have a game that included a die that could be used to impart an element of luck to the game and a number of stopwatches that could be used to impart an element of skill to the game.

GENERAL SUMMARY DISCUSSION OF INVENTION

It is thus an object of the invention to provide a game with a time-estimating element.

It is a further object of the invention to provide a game with a time-estimating element wherein the time-estimating element is accomplished by starting and stopping a stopwatch.

It is a still further object of the invention to provide a game with a time-estimating element that includes providing a game board having token spaces laid out thereon and wherein each player can elect to travel in any direction between adjacent token spaces during his/her given turn.

It is a still further object of the invention to provide a game with a time-estimating element that includes a number of time-estimating challenges.

It is a still further object of the invention to provide a game with a time-estimating element that can be won by outlasting the other players or by being the first to collect a preset number of time-saver cards.

It is a still further object of the invention to provide a game with a time-estimating element that accomplishes some or all of the above objects in combination Accordingly, a game with a time-estimating element is provided. The game includes game playing equipment comprising one position token for each player; a game board having a time-keeping timeline for each player and a number of interconnected token spaces defined thereon, each time-keeping timeline having a sequence of time designated between a highest time number and a lowest time number, each token space being interconnected with at least two other token spaces and having a consequence designation thereon for indicating the consequence of a player's position token landing thereon, at least two of the token spaces being designated a time-saver space, at least one of the token spaces being designated a card drawing space, at least one of the token spaces being designated a time out space; a number of consequence cards each having a consequence designated on the back surface thereof; a number of time-saver cards, at least two time-saver cards being keyed to each of the at least two time-saver spaces; one timekeeper block for each player for marking each player's remaining time on a respective time-keeping timeline; one stopwatch for each player; and a six-sided die. The game board is set for play by each player positioning his time-keeper block on the highest time number on his respective time-keeping timeline and his position token on any token space on the game board other than a time-out space; the first player begins play by rolling the six-sided die to achieve a number between one and six. A roll of one through four requires the player to move in any direction the number of spaces indicated, a roll of five requires the player to draw a consequence card and follow the instructions thereon, and a roll of six requires the player to move his position token to any token space on the game board. Consequence cards can result in the loss or gain of hours on the player's time-keeping timeline. Landing on a time-saver space results in a time-keeping challenge. The time-keeping challenge requires a number of the players to attempt to come as close as possible to a target time on the output display of his stopwatch without exceeding the target time. Each participating time-keeping challenge player is prohibited from looking at the time indicator on his and the other player's stopwatches when attempting to achieve the target time.

The player coming closest to the target time without exceeding the target time is awarded a time-saver card keyed to the particular time-saver space. Each player exceeding the target time is accessed a predetermined time penalty on his time-keeping timeline. When a player has no time remaining on his time-keeping timeline he is out of the game. The game can be won by being the last remaining player and by being the first player to achieve a time-saver card for each of the time-saver spaces.

In a preferred embodiment, the consequence cards include "good times/bad times" cards (GT/BT cards) and "making time/taking time" cards (MT/BT cards); and the game board includes at least one card drawing space designating GT/BT cards and one card drawing space designating MT/BT cards.

In another preferred embodiment, the game equipment further includes at least two fast reaction time-saver cards designating at least one fast reaction time-saver space; the game board further includes at least one token space designated a fast reaction time-saver space; the fast reaction time-saver card is awarded to the player achieving the absolute closest time on his stopwatch to the target time; and the game can be won when a player achieves one of the time-saver and fast reaction time-saver cards for each of the time-saver and fast reaction time-saver spaces.

In still another preferred embodiment, the game equipment further includes at least two on-target time-saver cards designating at least one on-target time-saver space; the game board further includes at least one token space designated an on-target time-saver space; the on-target time-saver card is awarded to the player achieving the exact target time on his stopwatch in a challenge that continues until one player achieves the exact target time; and the game can be won when a player achieves one of the time-saver and on-target time-saver cards for each of the time-saver and on-target time-saver spaces. The game can also include combinations of time-saver, fast reaction time-saver, and on-target time-saver spaces.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
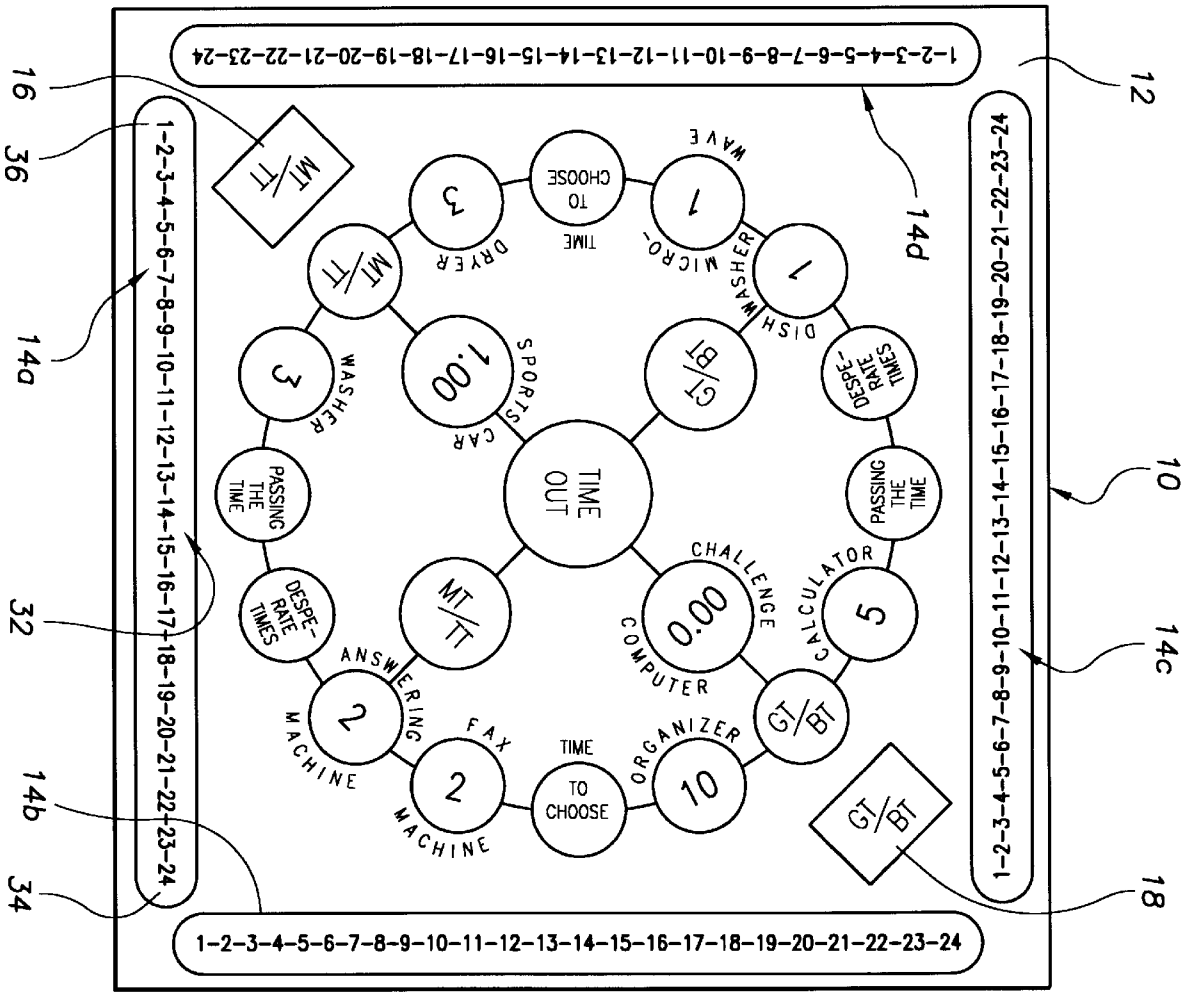
FIG. 1 is a top plan view showing an exemplary layout of the time-keeping timelines and the token spaces on the surface of an exemplary game board.

FIG. 1 shows an exemplary embodiment of the game board, generally designated 10, that is used in playing the game with time-estimating element of the present invention. Game board 10 has an upper surface 12 upon which four time-keeping timelines 14*a–d*, a MT/TT consequence card positioning area 16, a GT/BT consequence card positioning area 18; and twenty-one token spaces including eight "time-saver" spaces 20*a–h* (FIG. 1A), one "fast reaction time-saver" space 21 (FIG. 1A), one "on-target time-saver" space 23 (FIG. 1A), four "card drawing" spaces 22*a–d* (FIG. 1B), one "time out" space 24 (FIG. 1B), two "time to choose" spaces 26*a–b* (FIG. 1B), two "passing the time" spaces 28*a–b* (FIG. 1B), and two "desperate times" spaces 30*a–b* (FIG. 1B). Each time-keeping timeline 14*a–d* includes a timeline sequence of time, generally designated 32, designated between a highest time number 34 and a lowest time number 36. In this embodiment, each highest time number 34 represents twenty-four hours and each lowest time number 36 represents one hour.

Figure 1A:
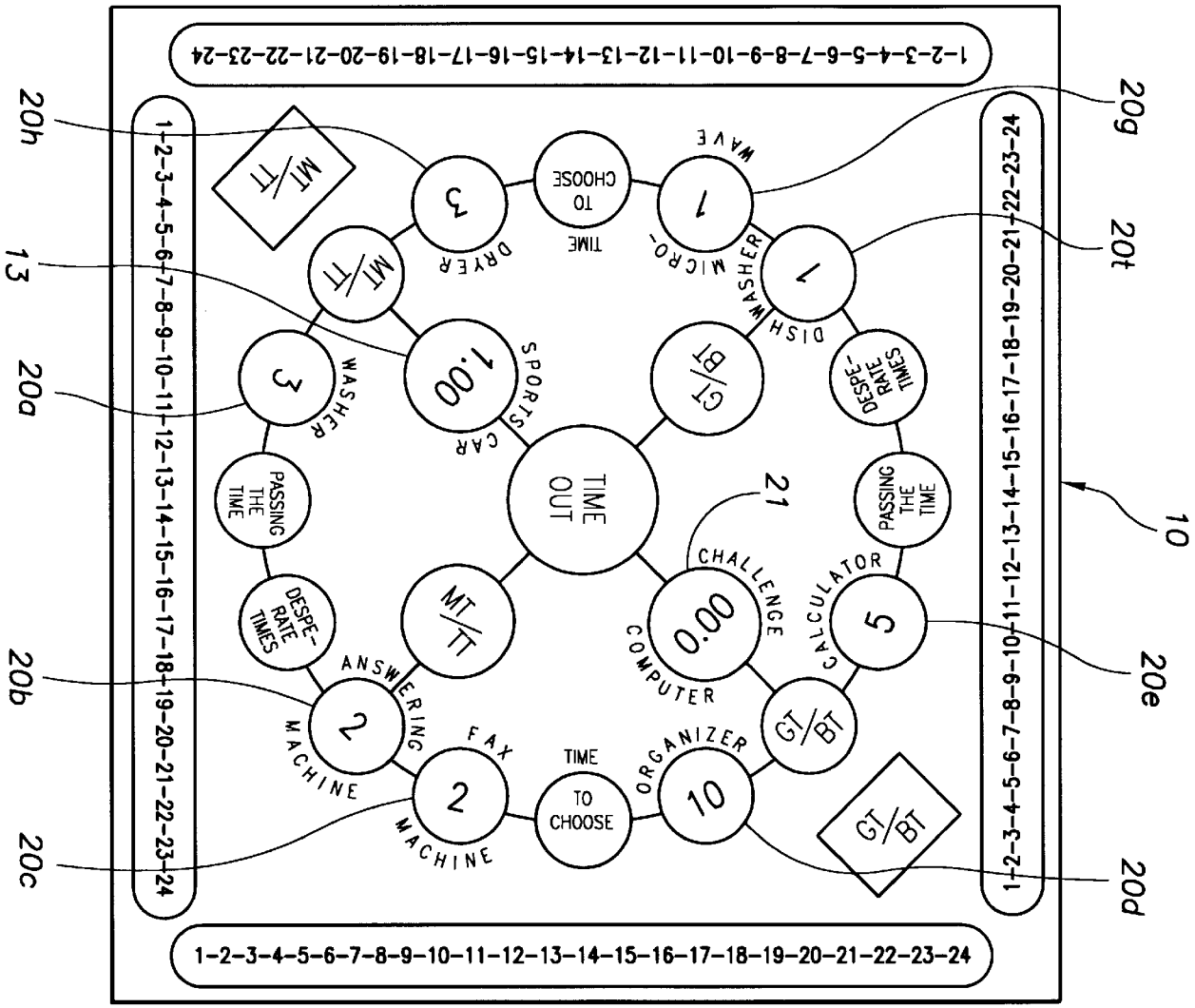
FIG. 1A is a second top plan view showing an exemplary layout of the time-keeping timelines and the token spaces on the surface of an exemplary game board.
Figure 1B:
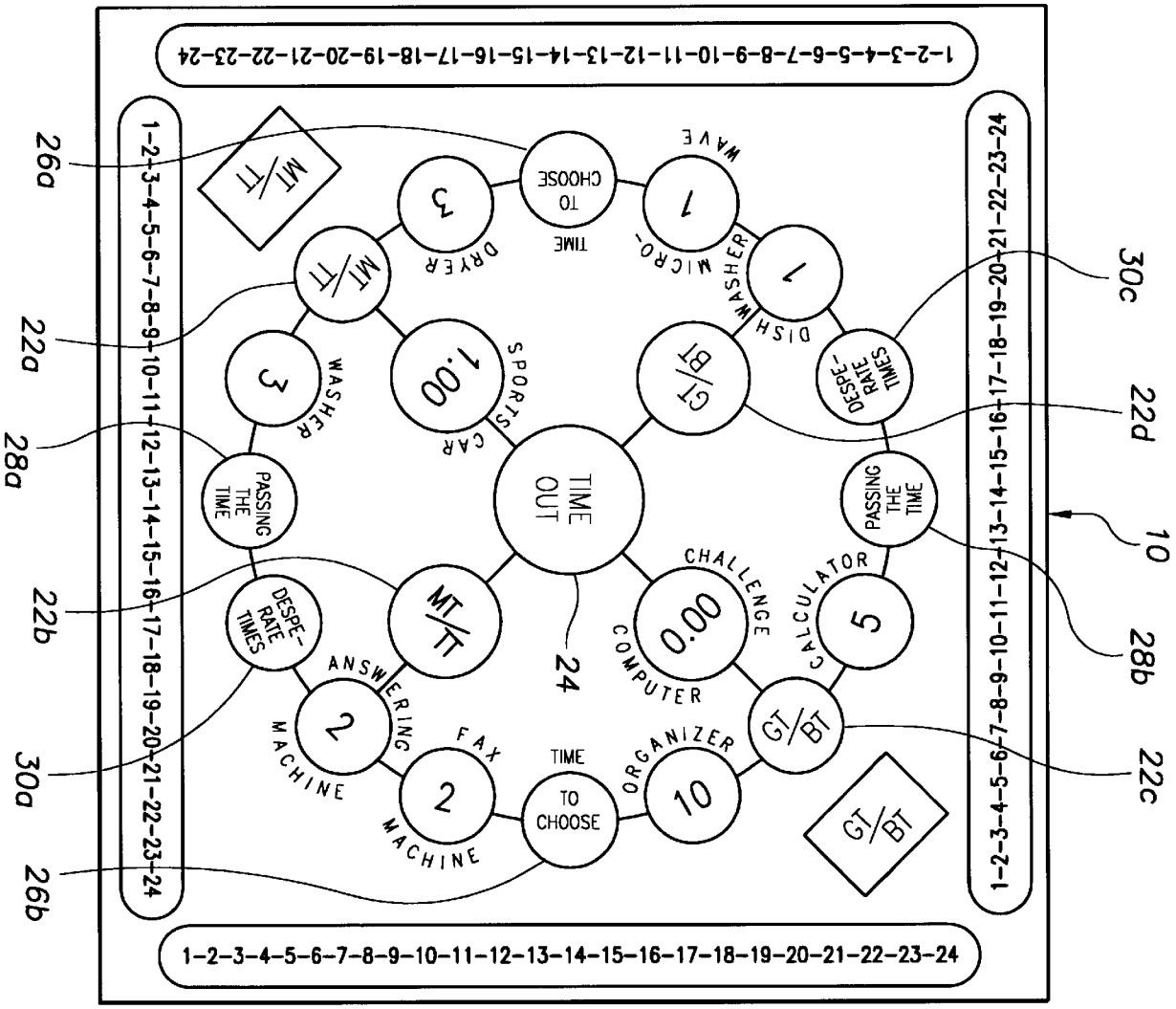
FIG. 1B is third top plan view showing an exemplary layout of the time-keeping timelines and the token spaces on the surface of an exemplary game board.

With reference to FIG. 1A, each of the time-saver spaces 20*a–h*,21,23 is keyed to a particular item in order to assist the player's in identifying particular time-saver spaces 20*a–h*. Time-saver space 20*a* is identified with a washer. Time-saver space 20*b* is identified with an answering machine. Time-saver space 20*c* is identified with a FAX machine. Time-saver space 20*d* is identified with an organizer. Time-saver space 20*e* is identified with a calculator. Time-saver space 20*f* is identified with a dishwasher. Time-saver space 20*g* is identified with a microwave oven. Time-saver space 20*h* is identified with a clothes dryer. Fast reaction time-saver space 21 is identified with a computer. On-target time-saver space 23 is identified with a sports car. Although each of the time-saver spaces 20*a–h*,21,23 in this embodiment is identified with a particular item, the item is merely a device for allowing the players to readily identify a particular time-saver space 20*a–h*,21,23 and therefore can be any type of item or thing.

Figure 2:
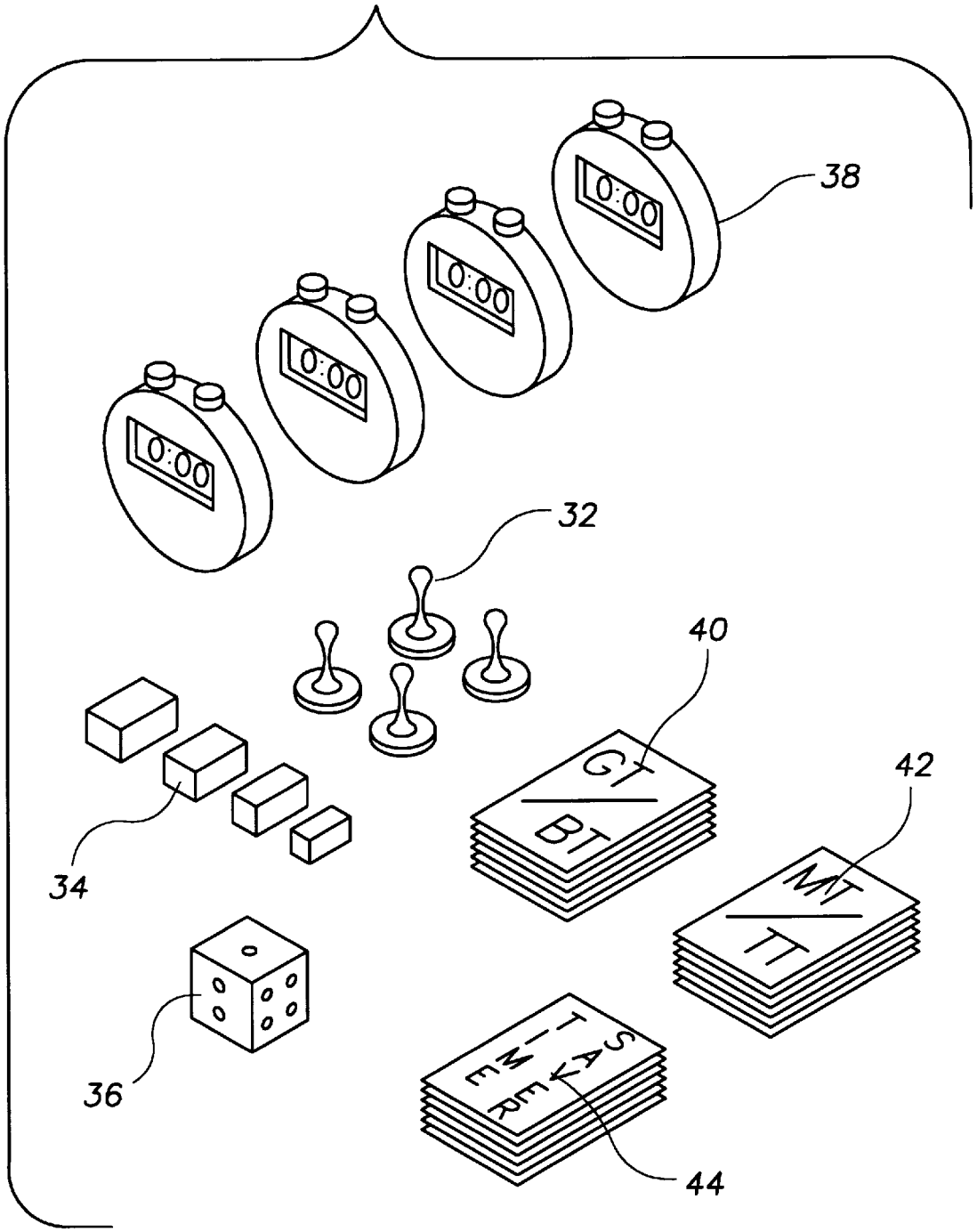
FIG. 2 is a perspective view showing a stack of GT/BT cards; a stack of MT/TT cards; a number of position tokens; a combined stack of time-saver, fast reaction time-saver, and on-target time-saver cards; a number of time-keeper blocks; a number of stopwatches and a six-sided die.

With reference to FIG. 2, the game equipment used to play the present invention also includes four molded plastic position tokens 33, four molded plastic time-keeper blocks 34, a six-sided die 36, four digital display stopwatches 38, a stack of GT/BT cards 40, a stack of MT/TT cards 42, and a stack of time-saver cards 44. Each of the position tokens 33 is a distinct color to enable each player to readily identify his own and other player's position tokens. Each of the time-keeper blocks 34 is color matched to one of the position tokens. Six-sided die 36 is a conventional six-sided die having the numbers one-six formed into the sides thereof. Stopwatches 38 are conventional digital display stopwatches that display down to hundredths of a second.

Each of the GT/BT cards 40 and the MT/TT cards 42 is a printed cardboard card having a back surface upon which a consequence is detailed. The consequences can include receiving or losing hours on a player's time-keeping timeline 14*a–d*.

The combined stack of time-saver cards 44 includes at least two time-saver cards 44*a* keyed to each of the time-saver, fast reaction time-saver, and on-target time-saver spaces 20*a–h*,21,23. During play, landing on a time-saver space 20*a–h*, a fast reaction time-saver space 21, or an on-target time saver space 23 results in a "race against time" between the players.

When the "race against time" is the result of landing on a time-saver space 20*a–h*, the "race against time" requires a group of the players to attempt to achieve a display output on his stopwatch 38 (FIG. 2) that is closest without exceeding a target time. The player winning the "race against time" is awarded a time-saver card 44 (FIG. 2) keyed to the particular time-saver spot 20*a–h* and each player exceeding the target time is penalized a predetermined number of time hours on his time-keeping timeline 14.

When the "race against time" is the result of landing on a fast reaction time-saver space 21, the "race against time" is conducted in the same manner except the winner is the player with the stopwatch display that is closest to the target time. No penalty is assessed against players for exceeding the target time. In either case, should a player achieve the exact target time the player's time-keeping timeline 14 is reset to the highest time number 34.

When the "race against time" is the result of landing on an on-target time saver space 23, the "race against time" comprises each eligible player attempting to achieve the exact target time on the display of his stopwatch 38. Players continue achieve the exact target time until one player achieves the target time. The player achieving the exact target time is the winner and is awarded the time-saver card 44 (FIG. 2) for the on-target time-saver space 23. The game can be won by being the first player to collect one time-saver card 44 (FIG. 2) for each time-saver space 21*a–h*, fast reaction time-saver space 21, and on-target time-saver space 23.

During play of the game a player's position token 33 landing on any of the four "card drawing" spaces 22*a–d* (FIG. 1B) results in the player drawing the indicated MT/TT card 42*a* or the GT/BT card 40*a*. A player's position token 33 landing on the "time out" space 24 results in protection from participating in all "races against time".

A player's position token 33 landing on a "time to choose" space 26*a–b* results in a head-to-head "race against time" between the player with the position token 33 and any one other player of that player's choosing as long as each player is in possession of at least one time-saver card 44*a*. The target time of the player with the position token 33 is used in the head-to-head "race against time". The winner of the head-to-head "race against time" is awarded the other player's time-saver card 44*a*.

A player's position token 33 landing on any of the two "passing the time" spaces 28*a–b* results in a head to head "race against time" with the target time to be used is the target time of a time-saver card 44*a* in possession of the player. The winner of this head to head "race against time" is awarded a number of hours from the losing player's time-keeping timeline 14.

A player's position token 33 landing on any of the two "desperate times" spaces 30*a–b* results in a "race against time" with all eligible player's wherein the player with the position token 33 is required to look away from his stopwatch display while each of the other players are allowed to view his stopwatch display. The player rolls the die a first time to determine the target time and a second time to determine the number of hours at stake. Only the player landing on the "desperate times" space 30*a–b* receives or loses the hours at stake.

An exemplary method of playing the game of the invention will now be described with general reference to FIGS. 1, 1A, 1B, and 2. The method includes the steps of 1) providing game equipment including a game board 10, four position tokens 33, four time-keeper blocks 34, a six-sided die 36, four stopwatches 38, a stack of GT/BT cards 40, a stack of MT/TT cards 42, and a stack of time-saver cards 44; 2) positioning a position token 33 on any token space on game board 10 except time out space 24 and a time-keeping block 34 on the highest time number 34 of an assigned time-keeping timeline 14*a–d* for each player; 3) a first player then rolls die 36, if the roll results in a number between one through four inclusive, the player moves his position token 33 that number of token spaces in any continuous direction and then performs the activity designated at the final token space; if the roll results in a five, the player does not move his position token 33 and draws either a MT/TT card 42 or a GT/BT card 40 and receives the consequence detailed on the back thereof; if the roll results in a six, the player is allowed to move his position token 33 to any token space on the board; and 4) players take turns rolling die 36 until a winner is declared.

It can be seen from the preceding description that a game with a time-estimating element has been provided wherein the time-estimating element is accomplished by starting and stopping a stopwatch; that includes providing a game board having token spaces laid out thereon and wherein each player can elect to travel in any direction between adjacent token spaces during his/her given turn; that includes a number of time-estimating challenges; and that can be won by outlasting the other players or by being the first to collect a preset number of time-saver cards.

It is noted that the embodiment of the game with time-estimating element described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A game with time-estimating element comprising:

game equipment comprising:

a number of position tokens;

a game board having a number of time-keeping timelines and a number of interconnected token spaces defined thereon, each time-keeping timeline having a sequence of time designated between a highest time number and a lowest time number, each token space being interconnected with at least two other token spaces and having a consequence designation thereon for indicating said consequence of a player's position token landing thereon, at least two of said token spaces being designated a time-saver space, at least one of said token spaces being designated a card drawing space, at least one of said token spaces being designated a time out space;

a number of consequence cards each having a consequence designated on said back surface thereof;

a number of time-saver cards, at least two time-saver cards being keyed to each of said at least two time-saver spaces;

one timekeeper block for each player for marking each player's remaining time on a respective time-keeping timeline;

a number of stopwatches; and a six-sided die.

2. The game with time-estimating element of claim 1, wherein:

said consequence cards include "good times/bad times" cards (GT/BT cards) and "making time/taking time" cards (MT/BT cards); and said game board includes at least one card drawing space designating GT/BT cards and one card drawing space designating MT/BT cards.

3. The game with time-estimating element of claim 2, wherein:

said time-saver cards further include at least two fast reaction time-saver cards designating at least one fast reaction time-saver space; and said game board further includes at least one token space designated a fast reaction time-saver space.

4. The game with time-estimating element of claim 3 wherein:

said time-saver cards include at least two on-target time-saver cards designating at least one on-target time-saver space; and said game board further includes at least one token space designated an on-target time-saver space.

5. The game with time-estimating element of claim 2 wherein:

said time-saver cards include at least two on-target time-saver cards designating at least one on-target time-saver space; and said game board further includes at least one token space designated an on-target time-saver space.

6. The game with time-estimating element of claim 1, wherein:

said time-saver cards further include at least two fast reaction time-saver cards designating at least one fast reaction time-saver space; and said game board further includes at least one token space designated a fast reaction time-saver space.

7. The game with time-estimating element of claim 1 wherein:

said time-saver cards include at least two on-target time-saver cards designating at least one on-target time-saver space; and said game board further includes at least one token space designated an on-target time-saver space.

* * * * *